US010111534B2

(12) United States Patent
Valenta et al.

(10) Patent No.: US 10,111,534 B2
(45) Date of Patent: Oct. 30, 2018

(54) MATTRESS CONTAINING MICROENCAPSULATED PHASE CHANGE MATERIAL

(71) Applicant: Milliken & Company, Spartanburg, SC (US)

(72) Inventors: Petr Valenta, Greer, SC (US); Patrick R. Carroll, Spartanburg, SC (US); Will Ringo, Spartanburg, SC (US); Tripp Joyce, Spartanburg, SC (US)

(73) Assignee: Milliken & Company, Spartanburg, SC (US)

( * ) Notice: Subject to any disclaimer, the term of this patent is extended or adjusted under 35 U.S.C. 154(b) by 269 days.

(21) Appl. No.: 15/078,395

(22) Filed: Mar. 23, 2016

(65) Prior Publication Data

US 2017/0020299 A1 Jan. 26, 2017

Related U.S. Application Data

(60) Provisional application No. 62/141,587, filed on Apr. 1, 2015.

(51) Int. Cl.

| | |
|---|---|
| ***A47C 27/00*** | (2006.01) |
| ***A47C 27/12*** | (2006.01) |
| ***A47C 31/00*** | (2006.01) |
| ***A47C 21/04*** | (2006.01) |

(52) U.S. Cl.

CPC ..... *A47C 27/121* (2013.01); *A47C 21/046* (2013.01); *A47C 27/002* (2013.01); *A47C 27/122* (2013.01); *A47C 31/001* (2013.01)

(58) Field of Classification Search

CPC ..... A47C 27/00; A47C 27/10
USPC ..... 5/698, 737, 740
See application file for complete search history.

(56) References Cited

U.S. PATENT DOCUMENTS

| | | | | |
|---|---|---|---|---|
| 5,414,362 | A | 5/1995 | Gramling et al. | 324/503 |
| 5,786,029 | A | 7/1998 | Watanabe | 427/282 |
| 6,298,907 | B1 | 10/2001 | Colvin et al. | 165/46 |
| 6,514,362 | B1 | 2/2003 | Zuckerman et al. | 156/79 |
| 6,699,266 | B2 | 3/2004 | Lachenbruch et al. | 607/96 |
| 7,191,478 | B2 | 3/2007 | Schmidt | 5/502 |
| 7,446,065 | B2 | 11/2008 | Wenstrup et al. | 442/415 |
| 7,670,968 | B2 | 3/2010 | Bohringer et al. | 442/131 |
| 2005/0227047 | A1 | 10/2005 | Sutter et al. | 428/195.1 |
| 2007/0006383 | A1* | 1/2007 | Ogle | A47C 27/122 5/698 |

(Continued)

FOREIGN PATENT DOCUMENTS

| | | |
|---|---|---|
| EP | 1 279 435 | 1/2003 |
| GB | 742295 | 12/1955 |
| WO | WO 1995/34609 | 12/1995 |

*Primary Examiner* — Fredrick C Conley
(74) *Attorney, Agent, or Firm* — Cheryl J. Brickey

(57) ABSTRACT

A mattress containing a core section, a high loft non-woven layer at least partially covering a first side of the core section and containing a plurality of heat and flame resistant fibers, bulking fibers, and binder fibers, a ticking layer at least partially covering the high loft non-woven layer and containing a textile layer, a pattern coated layer. The pattern coated layer may be printed on the high loft non-woven layer, the ticking layer, or any layer between the high loft non-woven layer and the ticking layer. The pattern coated layer contains a blend of microencapsulated phase change material (PCM) and a binder, wherein the PCM is fully encapsulated by the binder.

30 Claims, 6 Drawing Sheets

(56) References Cited

U.S. PATENT DOCUMENTS

| | | | | |
|---|---|---|---|---|
| 2010/0263128 | A1 | 10/2010 | Lean et al. | 5/636 |
| 2015/0067967 | A1* | 3/2015 | Tyree | A47C 27/056 5/691 |

* cited by examiner

MATTRESS CONTAINING MICROENCAPSULATED PHASE CHANGE MATERIAL

RELATED APPLICATIONS

This application claims priority to U.S. Provisional Patent Application 62/141,587, entitled, "Mattress Containing Microencapsulated Phase Change Material" filed on Apr. 1, 2015.

TECHNICAL FIELD OF THE INVENTION

The invention provides a mattress having a pattern coated layer of microencapsulated phase change material on at least one of the high loft non-woven layer, the ticking layer, or a layer between the high loft non-woven layer and the ticking layer.

BACKGROUND

Some foam mattress (and traditional inner spring mattresses) suffer from an "overheating sensation" where the mattress absorbs the body heat from the user and makes the user feel overly hot. It is desirable to have a mattress that retains its breathability but reduces the "overheating sensation".

BRIEF SUMMARY OF THE INVENTION

A mattress containing a core section, a high loft non-woven layer at least partially covering a first side of the core section and containing a plurality of heat and flame resistant fibers, bulking fibers, and binder fibers, a ticking layer at least partially covering the high loft non-woven layer and containing a textile layer, a pattern coated layer. The pattern coated layer may be printed on the high loft non-woven layer, the ticking layer, or any layer between the high loft non-woven layer and the ticking layer. The pattern coated layer contains a blend of microencapsulated phase change material (PCM) and a binder, wherein the PCM is fully encapsulated by the binder.

BRIEF DESCRIPTION OF THE FIGURES

An embodiment of the present invention will now be described by way of example, with reference to the accompanying drawings.

DETAILED DESCRIPTION OF THE INVENTION

Figure 1:
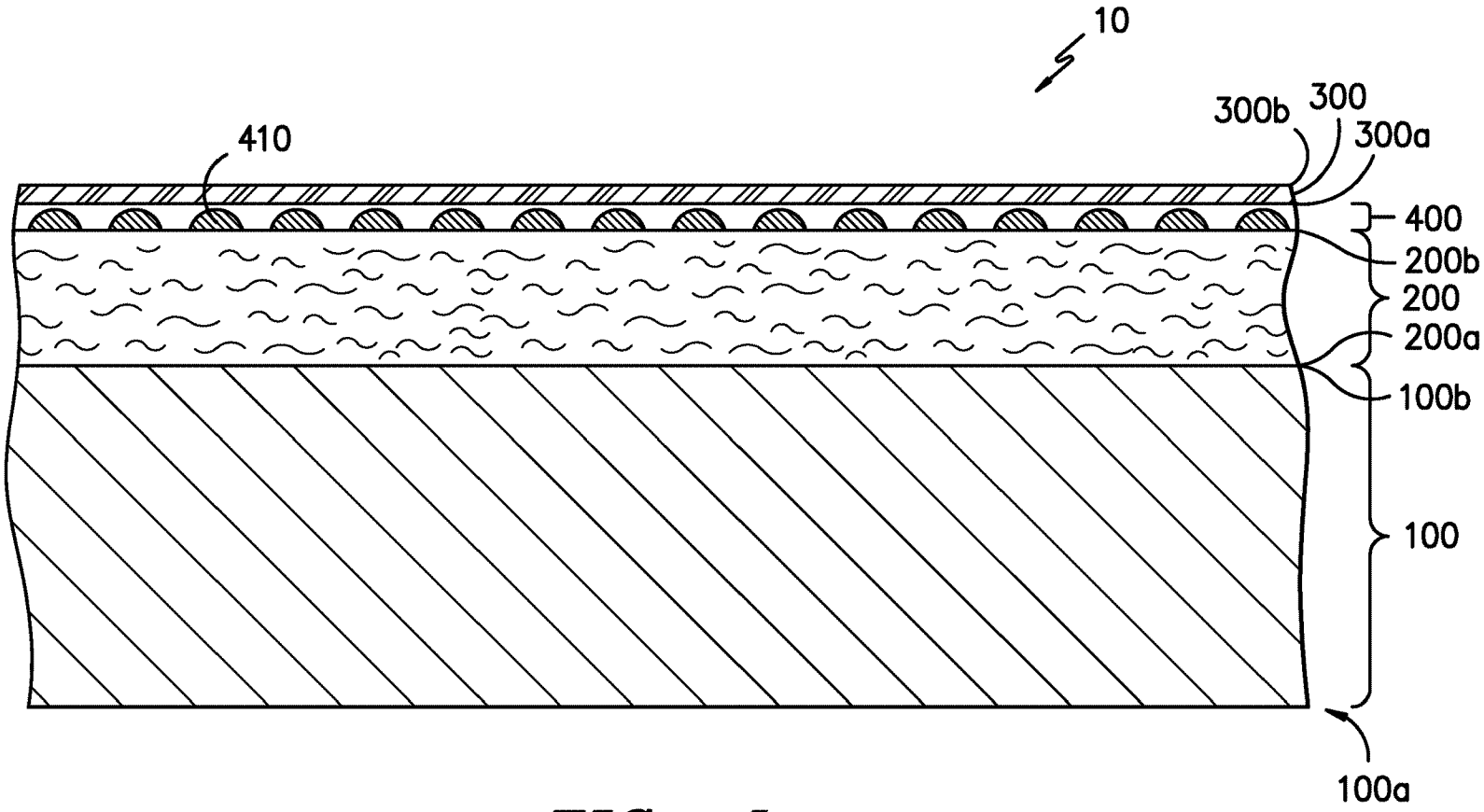
FIGS. 1-3 are cross-sectional views of different embodiments of mattresses of the invention.

Unlike use of PCM fibers or PCM dispersed in foam, screen printing under ticking or on ticking allows to bring a significant mass of PCM to the close proximity of the human body. Unlike coating, screen printing of patterns (not in a foam) provides a flexible layer which is less susceptible to breaking when exposed to bending and stretching.

The core section 100 of the mattress can be any suitable mattress core including both foam and inner spring mattress cores. On the first side 100*a* of the core section 100 is a high loft non-woven layer 200. While the high loft non-woven layer 200 is shown directly on and in direct contact with the core section 100, there may be a space between the two layers 100, 200, or there may be additional layers between the core section 100 and the high loft non-woven layer 200. The high loft non-woven layer 200 contains an inner side 200*a* and an outer side 200*b*. The high loft non-woven layer 200 is oriented such that the inner side 200*a* faces the second side 100*b* of the core section 100. The high loft non-woven layer 200 contains a plurality of heat and flame resistant fibers, bulking fibers, and binder fibers.

As used herein, heat and flame resistant fibers shall mean fibers having a Limiting Oxygen Index (LOI) value of 20.95 or greater, as determined by ISO 4589-1. Examples of heat and flame resistant fibers include, but are not limited to the following: fibers including oxidized polyacrylonitrile, aramid, or polyimid, flame resistant treated fibers, FR rayon, FR polyester, FR nylon, modacrylic, carbon fibers, or the like. These heat and flame resistant fibers may also act as the bulking fibers or may be sued in addition to the bulking fibers.

Bulking fibers are fibers that provide volume to the high loft non-woven layer 200. Examples of bulking fibers would include fibers with high denier per filament (one denier per filament or larger), high crimp fibers, hollow-fill fibers, and the like. These fibers provide mass and volume to the material. Some examples of bulking fibers include polyester, polypropylene, and cotton, as well as other low cost fibers. Preferably, the bulking fibers have a denier greater than about 12 denier. In another embodiment, the bulking fibers have a denier greater than about 15 denier. The bulking fibers are preferably staple fibers. In one embodiment, the bulking fibers do not a circular cross section, but are fibers having a higher surface area, including but not limited to, segmented pie, 4DG, winged fibers, tri-lobal etc.

In one embodiment, the bulking fibers within the high loft non-woven layer 200 are randomly oriented within the high loft non-woven layer 200. In another embodiment, a majority of bulking fibers are oriented such that the fibers form an angle with the inner side 200*a* of the high loft non-woven layer 200 of between about 0 and 25 degrees. In another embodiment, a majority of bulking fibers are oriented such that the fibers form an angle with the inner side 200*a* of the high loft non-woven layer 200 of between about 0 and 25 degrees.

In another embodiment, the bulking fibers preferably are oriented generally in the z-direction (the z-direction is defined as the direction perpendicular to the plane formed by the inner side 200*a* of the high loft non-woven layer 200. The z-orientation of the bulking fibers allows for increased thickness of the high loft non-woven layer 200. Z-orientation allows for higher compression resistance and retention of loft during handling. Preferably, a majority of the bulking fibers have a tangential angle of between about 25 and 90 degrees to the normal of an inner boundary plane (defined to be a midpoint plane between the inner side 200*a* and the outer side 200*b*). This means that if a tangent was drawn on the bulking fibers at the midpoint between the outer side 200*b* and the inner side 200*a*, the angle formed by the tangent and the inner boundary plane would be between about 90 degrees and 25 degrees. More preferably, the angle formed by the tangent and the inner boundary plane would be between about 90 degrees and 45 degrees.

The binder fibers within the high loft non-woven layer 200 are bonded together to create a cohesive two-dimensional fiber network which anchors the bulking fibers and the heat and flame resistant fibers. The binder fibers are fibers that form an adhesion or bond with the other fibers. In one embodiment, the binder preferably are fibers that are heat activated. Examples of heat activated binder fibers are fibers that can melt at lower temperatures, such as low melt fibers, bi-component fibers, such as side-by-side or core and sheath fibers with a lower sheath melting temperature, and the like. In one embodiment, the binder fibers are a polyester core and sheath fiber with a lower melt temperature polyester sheath.

The binder fibers are preferably staple fibers. In one embodiment, the binder fibers are discernable fibers. In another embodiment, the binder fibers lose their fiber shape and form a coating on surrounding materials (the heat and flame resistant fibers and bulking fibers).

In one embodiment, the binder fibers are in an amount of less than about 60% wt of the whole high loft non-woven layer 200. In another embodiment, the binder fibers are in an amount of less than about 50% wt of the whole high loft non-woven layer 200. In another embodiment, the binder fibers are in an amount of less than about 40% wt of the whole high loft non-woven layer 200. Preferably, the binder fibers 40 have a denier less than or about equal to 15 denier, more preferably less than about 6 denier. In one embodiment, at least some of the binder fibers are nano-fibers (their diameter is less than one micrometer).

In one embodiment, the high loft non-woven layer 200 contains additional fibers. These may include, but are not limited to a second binder fiber having a different denier, staple length, composition, or melting point, a second bulking fiber having a different denier, staple length, or composition, and an effect fiber, providing benefit a desired aesthetic or function. These effect fibers may be used to impart color, chemical resistance (such as polyphenylene sulfide fibers and polytetrafluoroethylene fibers), moisture resistance (such as polytetrafluoroethylene fibers and topically treated polymer fibers), or others.

The fibers (binder fibers, bulking fibers, heat and flame resistant fibers, and any other fiber in the high loft non-woven layer 200) may additionally contain additives. Suitable additives include, but are not limited to, fillers, stabilizers, plasticizers, tackifiers, flow control agents, cure rate retarders, adhesion promoters (for example, silanes and titanates), adjuvants, impact modifiers, expandable microspheres, thermally conductive particles, electrically conductive particles, silica, glass, clay, talc, pigments, colorants, glass beads or bubbles, antioxidants, optical brighteners, antimicrobial agents, surfactants, fire retardants, and fluoropolymers. One or more of the above-described additives may be used to reduce the weight and/or cost of the resulting fiber and layer, adjust viscosity, or modify the thermal properties of the fiber or confer a range of physical properties derived from the physical property activity of the additive including electrical, optical, density-related, liquid barrier or adhesive tack related properties.

In one embodiment, the heat and flame resistant fibers, bulking fibers, and binder fibers are within the high loft non-woven layer 200 in an approximately uniform distribution. This would be consider a non-stratified construction. In another embodiment, the high loft non-woven layer 200 has a stratified construction meaning that the concentration of at least one of the fibers (the heat and flame resistant fibers, bulking fibers, and binder fibers) varies as a function of thickness of the layer (thickness being measured between the inner side 200*a* and the outer side 200*b*). In some applications, it is preferred to have a stratified non-woven as one can create a non-woven having certain fibers more concentrated at one of the sides (for example, where one would like to create a "skin" of melted binder on a side, a stratified construction can produce a non-woven having a higher concentration of binder fiber on a desired side).

Referring back to FIG. 1, there is shown a ticking layer 300 having an inner side 300*a* and an outer side 300*b*. Preferably, the outer side 300*b* of the ticking layer 300 forms the outermost surface of the mattress 10. The ticking layer comprises at least one suitable textile layer, including a knit, woven, or non-woven, and preferably contains decorative elements within the textile for visual appeal. The ticking layer may be formed of any suitable fibers and/or yarns, including but not limited to, cotton, polyester, nylon, rayon, and wool and may have any suitable thickness (defined to be the distance between the inner side 300*a* and the outer side 300*b*). The ticking layer may also be quilted, meaning that the ticking layer is actually comprised of multiple fabric layers that are then attached together through the use of stitching, adhesives, or other attachment means. While the ticking layer 300 is adjacent and directly touching the high loft non-woven layer 200 in FIG. 1, the ticking layer 300 may be set off from the high loft non-woven layer 200 by a space or may have an additional layer between the high loft non-woven layer 200 and the ticking layer 300.

The mattress 10 contains a pattern coated layer 400. This pattern coated layer contains a blend of microencapsulated phase change material (PCM) and a binder. This pattern coated layer may be on or between any suitable layers within the mattress, but it is advantageous to have the pattern coated layer 400 as close to the outermost surface of the mattress as possible. In one embodiment, the pattern coating layer can be on the outermost surface (ticking layer) of the mattress. Having the PCM material closer to the outermost surface of the mattress serves to increase its efficiency.

Figure 2:
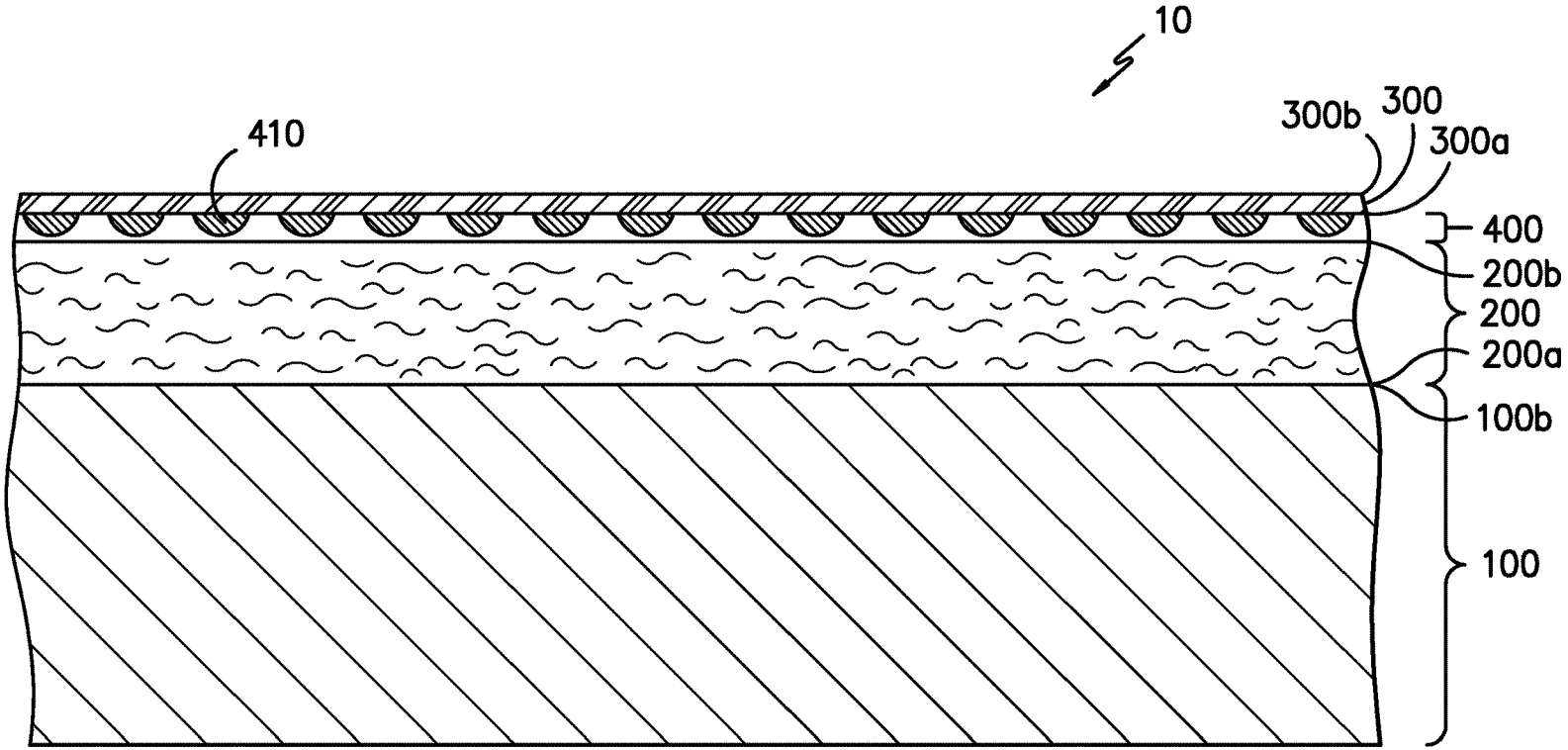
Figure 3:
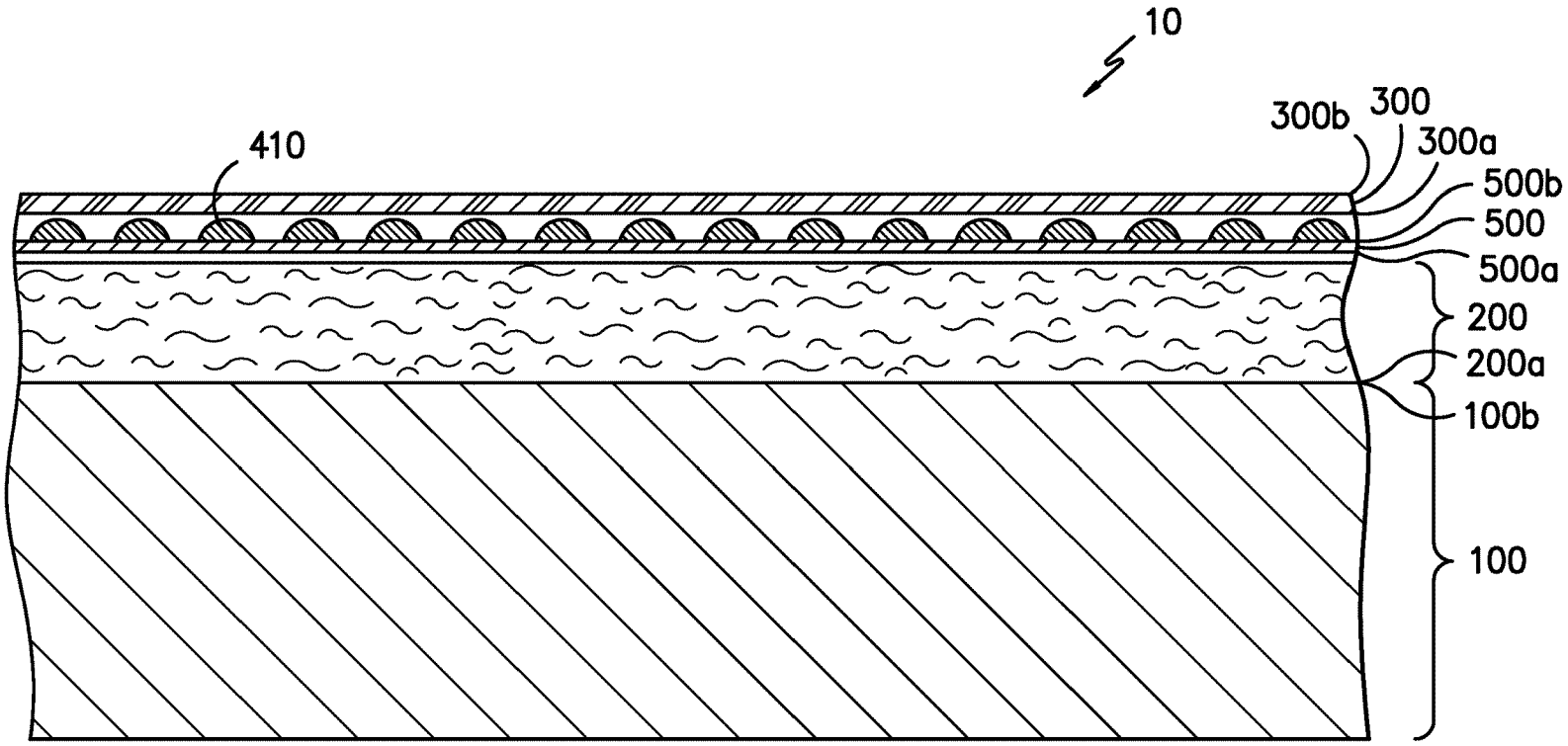

In one embodiment, as shown in FIG. 1, the pattern coated layer 400 is on the outer side 200*b* of the high loft non-woven layer 200. In another embodiment, as shown in FIG. 2, the pattern coated layer 400 is on the outer side 300*b* of the ticking layer. In another embodiment, as shown in FIG. 3, the pattern coated layer 400 is on an additional layer 500 (for example a scrim or other textile) having an inner side 500*a* and an outer side 500*b* which is between the high loft non-woven layer 200 and the ticking layer 300. On which layer (and which side of the layer) the patterned coated layer is on depends on manufacturability and desired end properties.

There are tradeoffs in the mattress of best heat transfer versus stiffness of the ticking for the placement of the PCM. The PCM may be printed on top of ticking and that would provide the best heat transfer and hence the best cooling effect. On the other hand, it would be exposed to increased abrasion and may cause ticking to be stiffer. In another embodiment, the PCM could be printed on the bottom of the ticking. In this case the cooling effect would be lower than having the PCM on the outermost surface of the mattress, but the PCM print would be better protected from abrasion and the stiffness of the ticking would be similar. In another embodiment, the PCM could be printed on the top layer of the non-woven. In this case the cooling effect would be similar to the PCM being on the inside surface of the ticking but the protection from abrasion would be the best from the three cases. The stiffness of the ticking would be the lowest since the print is not on the ticking. In another embodiment, the pattern coated layer 400 is on two or more of the layers (200, 300, 500) of the mattress.

Within the pattern coated layer 400, the microencapsulated PCM are preferably completely encapsulated by the binder. Preferably the PCM is That PCM is organic and is based on hydrocarbons. Preferably the average particle size of the PCM is between about 0.5 and 100 μm and are encapsulated by acrylic, melamine-formaldehyde, or similar polymers. Preferably, the PCM have a melting point (melting temperature) of between about 15 and 35° C. Preferably, the PCM is not in a foam or foam-like material. Foam may tend to insulate the PCM and reduce its effectiveness.

Examples of different types of pattern coatings are shown in FIGS. 4-9. While each of these FIGS. show the pattern coating 410 of the pattern coated layer 400 on the high loft non-woven 200, the pattern coated layer 400 may be applied in the same manner to any suitable layer within the mattress.

The patterned coating 410 may be continuous or discontinuous, regular and repeating or random. "Continuous" in this application means that from one edge of the fabric to the other edge there is a path that contains the patterned coating and that at least some of the patterned coating areas are connected. Examples of continuous coatings include FIGS. 6 and 7. "Discontinuous" in this application means that the patterned coated areas are discontinuous and not touching one another. In a discontinuous patterned coating, there is no path from one edge of the fabric to the other that contains the patterned coating. Examples of discontinuous coatings include FIGS. 4, 5 and 8. Regular or repeating patterns mean that the pattern has a repeating structure to it. FIGS. 4, 6, 7, and 8 illustrate repeating or regular patterns. FIG. 5 illustrates a random pattern where there is no repeat to the patterned coating. In a random pattern, it is preferred that the random pattern is also discontinuous, not continuous.

Figure 4:
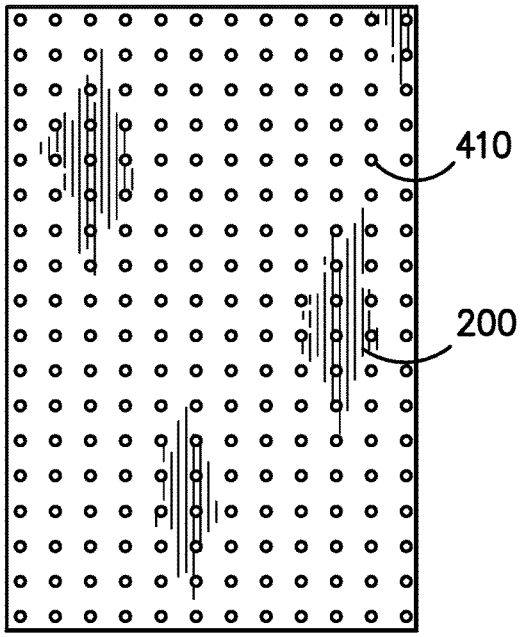
FIG. 4 is a schematic of a top view of a fabric having a discontinuous dot pattern of an adhesion promoter on surface of the fabric.
Figure 5:
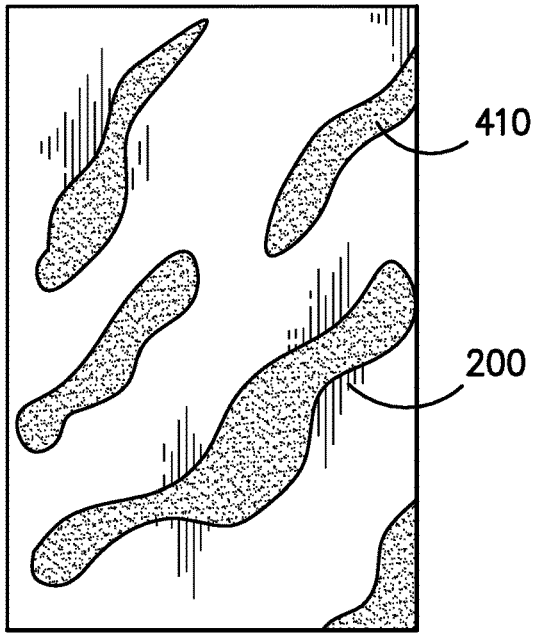
FIG. 5 is a schematic of a top view of a fabric having a discontinuous pattern of random areas of an adhesion promoter on surface of the fabric.
Figure 6:
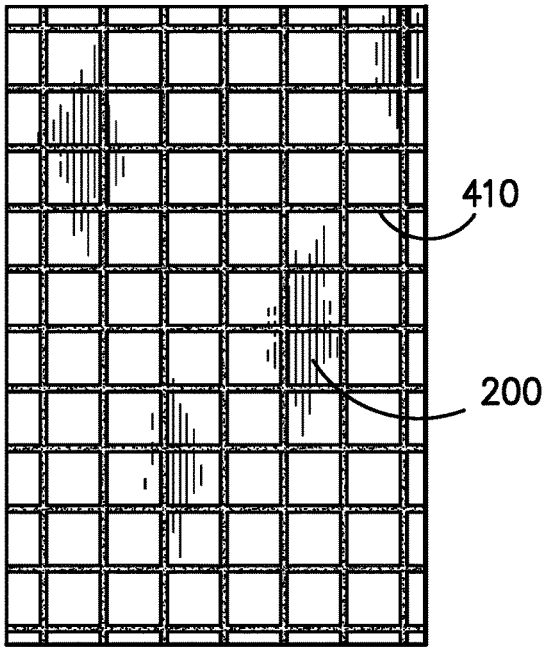
FIG. 6 is a schematic of a top view of a fabric having a grid pattern of an adhesion promoter on surface of the fabric.
Figure 7:
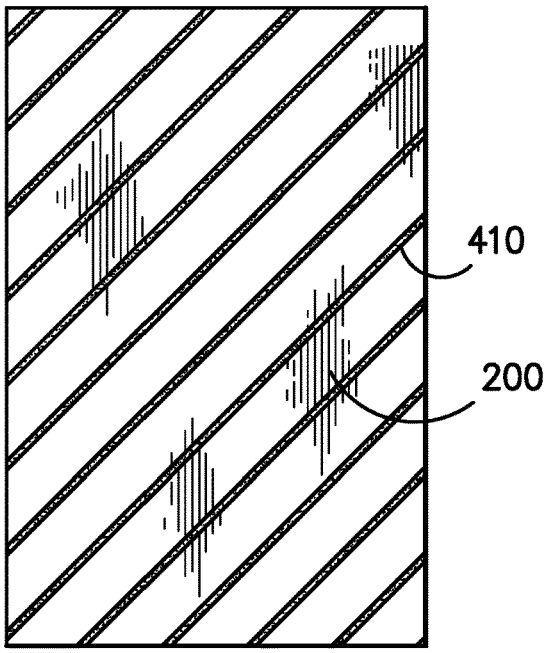
FIG. 7 a schematic of a top view of a fabric having pattern of a series of parallel lines of an adhesion promoter on surface of the fabric.
Figure 8:
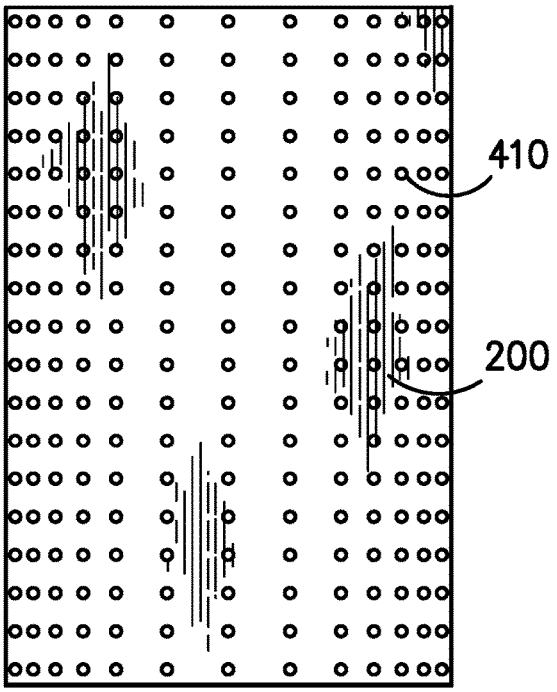
FIG. 8 is a schematic of a side view of a fabric showing the discontinuous pattern of the adhesion promoting chemistry on both sides of the fabric.

FIG. 4 illustrates the embodiment where the patterned coating is in a dot pattern. This pattern is discontinuous and repeating. The dots may be equally spaced on the fabric, or may have differing densities of dots or sizing of dots across the surface of the fabric. A dot pattern may be preferred for as it is resistant to breaking under mechanical pressure. FIG. 5 illustrates the embodiment where the patterned coating 410 is in random, discontinuous spotting pattern. FIG. 6 illustrates the embodiment where the patterned coating 410 is in a grid. This pattern is regular and continuous. FIG. 7 illustrates the embodiment where the patterned coating 410 is in a series of parallel lines. This pattern is also regular and continuous. The patterned coating 410 may take any other patterned form including but not limited to indicia, geometric shapes or patterns, and text.

Figure 9:
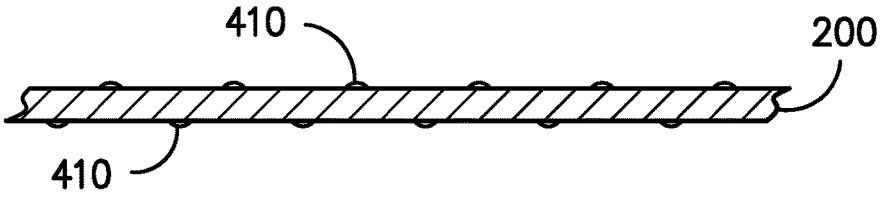
FIG. 9 is a schematic of a top view of a fabric having pattern of a dots of varying density across the fabric.

FIG. 9 illustrate a side views of the high loft non-woven layer 200 illustrating the patterned coating 410 both sides of the high loft non-woven layer. The patterned coatings 410 may be the same or different patterns and coverage on either side of the high loft non-woven layer 200.

The patterned coated layer 400 may be formed by any known method of forming a patterned coating including but not limited to screen printing, inkjet printing, gravure printing, patterned printing, thermal transfer, spray coating, and silk printing. Screen printing is preferred because is simple, cheap, common, versatile in terms of add-on, pattern. It is also mild to the microencapsulated PCM particles.

The thickness and/or physical composition of the patterned coating 410 may vary over the length and/or width of the layer coated. For example, it may be preferred in some embodiments to have a thicker coating or more densely packed pattern in some areas of layer such as the head or feet areas of a mattress. This can be seen, for example, in FIG. 8 where the dot pattern of the patterned coating layer 400 varies over the width of the layer 200.

In one embodiment, the patterned coating 410 of the pattern coated layer 400 covers between about 5 and 95% of the surface area of the layer coated (high loft non-woven layer 200, ticking layer 400, additional layer 300, or other). In other embodiments, the patterned coating may cover between about 5 and 70%, 10 and 60%, 45 and 90%, 45 and 75%, greater than 15%, greater than 20% and greater than 30% of the surface area of the layer coated. In one embodiment, the patterned coating has a (dry) add-on weight of between about 50 and 500 g/m$^2$, more preferably between about 50 and 200 g/m$^2$. In one embodiment, the thickness of the coating is between about 0.1 and 2.0 mm. In another embodiment, the air permeability of the coated fabrics is between about 5 and 500 cfm.

The claims are directed to a mattress and preferably the mattress is a flat (or mostly flat) mattress that people sleep one, but the mattress of the claims includes cushions, such as cushions on a sofa or couch) and pillows.

EXAMPLE

A PALADIN® FR barrier available from Milliken & Company was used as the high loft non-woven layer. The FR barrier is an 80/20 FR rayon/low melt PET blend having a 1 oz/ft$^2$ (305 g/m$^2$) areal density.

A patterned coating was applied to one side of the FR barrier. The patterned coating contained a microencapsulated PCM and a binder. The microencapsulated PCM was PURETEMP® 24 available from Encapsys/Enthropy and the binder was SERA PRINT® M-PHC available from Dystar which is believed to be a carboxymethylated cellulose.

The printing material contained 88% OWB (on weight of bath) of PURETEMP® 24 slurry (42% wt solids) and 12% OWB of SERA PRINT binder/thickner (35% wt solids). The dynamic viscosity of the print paste as 5,000 cP and the total solids of the paste was 40% wt.

The paste was printed by screen printing a dot pattern onto one side of the FR barrier. The dot pattern was a regular and repeating, noncontinuous pattern coating. The dots were approximately 12 mm in diameter and there was approximately 2 mm of space between the dots. Adjacent rows of dots were offset from one another for better packing density. The finished product (after drying the printed FR barrier at 250° F.) was 385 g/m$^2$ (11.36 oz/y$^2$).

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the subject matter of this application (especially in the context of the following claims) are to be construed to cover both the singular and the plural, unless otherwise indicated herein or clearly contradicted by context. The terms "comprising," "having," "including," and "containing" are to be construed as openended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the subject matter of the application and does not pose a limitation on the scope of the subject matter unless otherwise claimed. No language in the specification should be construed as indicating any non-claimed element as essential to the practice of the subject matter described herein.

Preferred embodiments of the subject matter of this application are described herein, including the best mode known to the inventors for carrying out the claimed subject matter. Variations of those preferred embodiments may become apparent to those of ordinary skill in the art upon reading the foregoing description. The inventors expect skilled artisans to employ such variations as appropriate, and the inventors intend for the subject matter described herein to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the present disclosure unless otherwise indicated herein or otherwise clearly contradicted by context.

What is claimed is:

1. A mattress comprising:

a core section, wherein the core section comprises a first side and an opposing second side connected by at least one side wall;

a high loft non-woven layer having an inner side, an outer side, a length, and a width, wherein the high loft non-woven layer at least partially covers the first side of the core section, wherein the high loft non-woven layer is oriented such that the inner side of the high loft non-woven layer faces the first side of the core section, and wherein the high loft non-woven layer comprises a plurality of heat and flame resistant fibers, bulking fibers, and binder fibers;

a pattern coated layer having a thickness and comprising a blend of microencapsulated phase change material (PCM) and a binder in a pattern, wherein the PCM is fully encapsulated by the binder and wherein the pattern coated layer overlays at least a portion of the outer side of the high loft non-woven layer, wherein the pattern is a regular, repeating pattern having a pattern density, wherein the pattern is continuous or discontinuous, and wherein at least one of the pattern coated layer thickness and pattern density vary over at least one of the length and width of the high loft non-woven layer; and, a ticking layer having an inner side and an outer side, wherein the ticking layer at least partially covers the high loft non-woven layer, wherein the ticking layer is oriented such that the inner side of the ticking layer faces the outer side of the high loft non-woven layer, and wherein the ticking layer comprises a textile layer.

2. The mattress of claim 1, wherein the outer side of the ticking layer forms the outermost surface of the mattress.

3. The mattress of claim 1, wherein the pattern of the patterned coating is discontinuous.

4. The mattress of claim 1, wherein the patterned coating covers between about 45 and 75% of the outer side of the high loft non-woven layer.

5. The mattress of claim 1, wherein the patterned coating has an add-on weight of between about 50 and 200 $g/m^2$.

6. The mattress of claim 1, wherein the heat and flame resistant fibers comprise FR rayon.

7. The mattress of claim 1, wherein the pattern of the patterned coating is a dot pattern.

8. The mattress of claim 1, wherein the PCM particles have an acrylic shell.

9. The mattress of claim 1, wherein the pattern of the patterned coating is continuous.

10. The mattress of claim 1, wherein the layer thickness of the pattern coated layer varies over at least one of the length and width of the high loft non-woven layer.

11. The mattress of claim 1, wherein the pattern density varies over at least one of the length and width of the high loft non-woven layer.

12. A mattress comprising:

a core section, wherein the core section comprises a first side and an opposing second side connected by at least one side wall;

a high loft non-woven layer having an inner side and an outer side, wherein the high loft non-woven layer at least partially covers the first side of the core section, wherein the high loft non-woven layer is oriented such that the inner side of the high loft non-woven layer faces the first side of the core section, and wherein the high loft non-woven layer comprises a plurality of heat and flame resistant fibers, bulking fibers, and binder fibers;

a ticking layer having an inner side and an outer side, wherein the ticking layer at least partially covers the high loft non-woven layer, wherein the ticking layer is oriented such that the inner side of the ticking layer faces the outer side of the high loft non-woven layer, and wherein the exterior ticking layer comprises a textile layer;

an additional layer having a length and a width; and, a pattern coated layer comprising a blend of microencapsulated phase change material (PCM) and a binder in a pattern, wherein the PCM is fully encapsulated by the binder and wherein the pattern coated layer overlays a portion of the inner side of the additional layer, wherein the pattern is a regular, repeating pattern having a pattern density, wherein the pattern is continuous or discontinuous, and wherein at least one of the pattern coated layer thickness and pattern density vary over at least one of the length and width of the high loft non-woven layer.

13. The mattress of claim 12, wherein the pattern of the patterned coating is a dot pattern.

14. The mattress of claim 12, wherein the outer side of the ticking layer forms the outermost surface of the mattress.

15. The mattress of claim 12, wherein the pattern of the patterned coating is discontinuous.

16. The mattress of claim 12, wherein the patterned coating covers between about 45 and 75% of the inner side of the ticking layer.

17. The mattress of claim 12, wherein the patterned coating has an add-on weight of between about 50 and 200 $g/m^2$.

18. The mattress of claim 12, wherein the pattern density varies over at least one of the length and width of the additional layer.

19. The mattress of claim 12, wherein the microencapsulated PCM comprises PCM particles having an average size less than about 1000 μm.

20. The mattress of claim 12, wherein the PCM particles have an acrylic shell.

21. The mattress of claim 12, wherein the additional layer is a scrim.

22. The mattress of claim 12, wherein the layer thickness of the pattern coated layer varies over at least one of the length and width of the additional layer.

23. The mattress of claim 12, wherein the pattern of the patterned coating is continuous.

24. A mattress comprising:

a core section, wherein the core section comprises a first side and an opposing second side connected by at least one side wall;

a high loft non-woven layer having an inner side and an outer side, wherein the high loft non-woven layer at least partially covers the first side of the core section, wherein the high loft non-woven layer is oriented such that the inner side of the high loft non-woven layer faces the first side of the core section, and wherein the high loft non-woven layer comprises a plurality of heat and flame resistant fibers, bulking fibers, and binder fibers;

a ticking layer having an inner side, an outer side, a length, and a width, wherein the ticking layer at least partially covers the high loft non-woven layer, wherein the ticking layer is oriented such that the inner side of the ticking layer faces the outer side of the high loft non-woven layer, and wherein the exterior ticking layer comprises a textile layer; and, a pattern coated layer having a thickness and comprising a blend of microencapsulated phase change material (PCM) and a binder in a pattern, wherein the PCM is fully encapsulated by the binder and wherein the pattern coated layer overlays at least a portion of the inner side of the ticking layer, wherein the pattern is a regular, repeating pattern having a pattern density, wherein the pattern is continuous or discontinuous, and wherein at least one of the pattern coated layer thickness and pattern density vary over at least one of the length and width of the high loft non-woven layer.

25. The mattress of claim 24, wherein the outer side of the ticking layer forms the outermost surface of the mattress.

26. The mattress of claim 24, wherein the layer thickness of the pattern coated layer varies over at least one of the length and width of the ticking layer.

27. The mattress of claim 25, wherein the pattern of the patterned coating is continuous.

28. The mattress of claim 24, wherein the pattern of the patterned coating is discontinuous.

29. The mattress of claim 24, wherein the pattern density varies over at least one of the length and width of the ticking layer.

30. The mattress of claim 24, wherein the pattern of the patterned coating is a dot pattern.

* * * * *